United States Patent [19]

Knippel et al.

[11] 4,295,430

[45] Oct. 20, 1981

[54] RAILWAY HOPPER CAR LATCH MECHANISM

[75] Inventors: Willis H. Knippel, Palos Park; Ray Ferris, Thornton, both of Ill.

[73] Assignee: Pullman Incorporated, Chicago, Ill.

[21] Appl. No.: 124,506

[22] Filed: Feb. 25, 1980

[51] Int. Cl.[3] ..... B61D 7/18; B61D 7/22; B61D 7/26

[52] U.S. Cl. ..... 105/308 E; 105/308 R

[58] Field of Search ..... 105/308 E, 308 R

[56] References Cited

U.S. PATENT DOCUMENTS

| | | | |
|---|---|---|---|
| 1,584,417 | 5/1926 | Wine | 105/308 R |
| 2,225,463 | 12/1940 | Rose | 105/308 R X |
| 2,286,958 | 6/1942 | Haessler | 105/308 R |
| 3,931,768 | 1/1976 | Price et al. | 105/308 E X |
| 4,158,996 | 6/1979 | Marulic et al. | 105/308 R |

*Primary Examiner*—Joseph F. Peters, Jr.
*Assistant Examiner*—Howard Beltran
*Attorney, Agent, or Firm*—Richard J. Myers

[57] ABSTRACT

A door locking mechanism for a railway hopper car includes a rotatable latch or rotor member engaging a keeper on the door for releasably locking the same. The latch member includes abutment faces which are engaged in locking position by a spring loaded lever. The lever includes a flat surface engaging a rounded cam surface on the rotor for positioning the same in a release position.

10 Claims, 2 Drawing Figures

RAILWAY HOPPER CAR LATCH MECHANISM

BACKGROUND OF THE INVENTION

1. Field of the Invention

The present invention is concerned with railway hopper cars and specifically with a door latching mechanism.

2. Description of the Prior Art

The prior art is replete with different latch arrangements for hopper car doors. The following patents exemplify the prior art. U.S. Pat. No. 1,584,417, W. E. Wine, discloses a door locking mechanism of the hook type. Another U.S. Pat. No. 2,225,463, E. J. Rose, discloses a mine car door operating mechanism having a lock means coacting with the door holding to prevent the release of the doors. U.S. Pat. No. 2,286,958, W. M. Haessler, discloses a latch mechanism for drop bottom mine cars in which the doors open in sequence. Still another U.S. Pat. No. 3,931,768, Price, et al., discloses a door operating mechanism mounted on a hopper vehicle. The present invention is an improvement over these patents since it discloses a latch mechanism which permits a plurality of the devices for a plurality of doors to unlock in unison with relatively low release force required.

SUMMARY OF THE INVENTION

The latch mechanism of the present invention is particularly adaptable for the bottom or side dump closure doors of a railway hopper car. Hoppers of such a car include lower discharge openings which are closed by swinging doors. Doors which are maintained closed in the transit condition are either manually or automatically released in unison so that the doors are swung open and the load is discharged. Such automatic release may be occasioned by a track tripping device which is operative when the car reaches a position adjacent to the device located near the track. The present mechanism comprises a latch and latch mechanism which is easily tripped into the open position when desired by a mechanism designed to release a plurality of such latches at one time, i.e., in concert. Previous devices included latch mechanisms in which the required release forces were too high and the latches would not release at the same time. The present latch design solves this problem.

Also, the present latch is operative to position the rotor in a position wherein the door can be swung closed, simultaneously closing each of the rotor locks again in concert.

In the present mechanism an F-shaped latch member includes a gathering notch which in the closed position engages a keeper rod which is mounted on the door of the hopper. In the closed position an upper position of a spring tensioned lever is in secure engagement with flat abutment faces adjacent to an arcuate or rounded surface at the latch member. This provides a solid stop arrangement preventing movement of the latch member to the open position. The lever is suitably mounted on a bracket which is connected to one side of the hopper and this bracket also provides a pivot support for the F-shaped latch member.

DESCRIPTION OF THE PREFERRED EMBODIMENT

Figure 1:
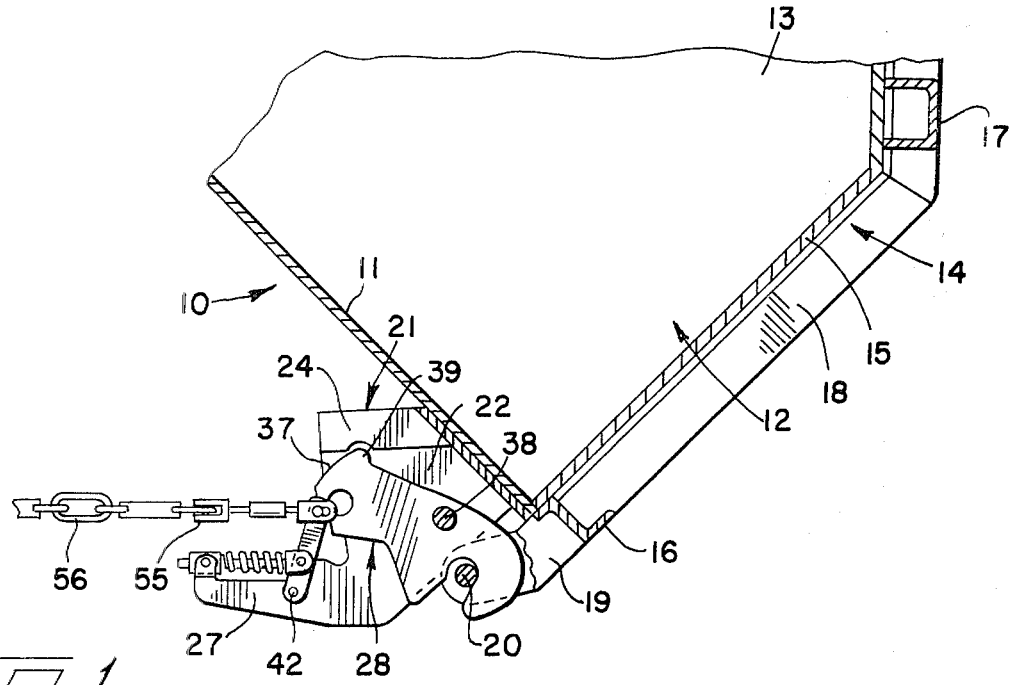
FIG. 1 is a sectional side view of a hopper and door showing a latch arrangement in loading position.

Referring to FIG. 1 a hopper 10, of a hopper car (not shown) includes a slope sheet 11, having at its lower end a discharge opening 12, the slope sheet 11 having end walls 13, only one of which is shown. A door 14 includes a door panel 15 provided with longitudinal stringers 16 and 17 interconnected by transverse support members 18. A keeper bracket 19 is connected to the door 14 and projects outwardly therefrom, the same being of a clevis shape and including a keeper rod 20.

A latch support bracket 21 includes a pair of vertical plates 22, only one of which is shown, the plates 22 being spaced apart, and both being connected to a base plate 23 suitably mounted on the slope sheet 11. A stop block 24 is secured between the upper edge of the plates 22 and is provided at its lower surfaces with a notch 25.

A latch arrangement is generally designated at 26 and is supported on bracket extension arms 27 and plates 22. The latch mechanism includes a latch rotor 28 having a jaw 29 at one end including a gathering recess 30 formed by a pair of projecting fingers 31 and 32. The rotor includes a relatively narrow body 33 which, with the flanges 31 and 32, provides a relatively unique F-shaped configuration. The narrow body includes at one end a notch or recess 34 which is contiguous with a pair of flat stop abutments 35 and 36. The end of the rotor 26 is provided with a cam surface 37 of curved or arcuate shape the same being developed about a pivot pin 38 which is supported on the plates 22 and on which the rotor 26 pivots. For the purpose of the present embodiment the rotor may also be entitled as a latch or as a keeper member. The body 33 also includes a projection 39 which in the locking position of the rotor is disposed in the notch 25 of the block 24.

A rotor release mechanism 40 includes a lever 41 pivotally supported on a pivot 42 or arm 27. A rod 43 is pivotally connected to the lever 41 by means of a clevis 44 and pin 45. The rod 43 projects through a sleeve 46 pivotally supported on ears 47 of the arms 27, by means of a pivot pin 48. A spring 49 is held captive and urges the lever 41 against the cam face 37. The upper end of the lever 41 is pivotally connected by means of a pivot 50 to a slotted clevis 51. The clevis 51 is connected to a threaded rod 52, connected to a turnbuckle 53, in turn connected to another threaded rod 54 connected to a clevis 55. The clevis 55 is connected to a pull chain 56 which may be connected to mechanical, pneumatic, or hydraulic actuating means adapted to release a plurality of the loading mechanisms, in turn unlocking a plurality of doors, such mechanisms being conventional.

THE OPERATION

Figure 2:
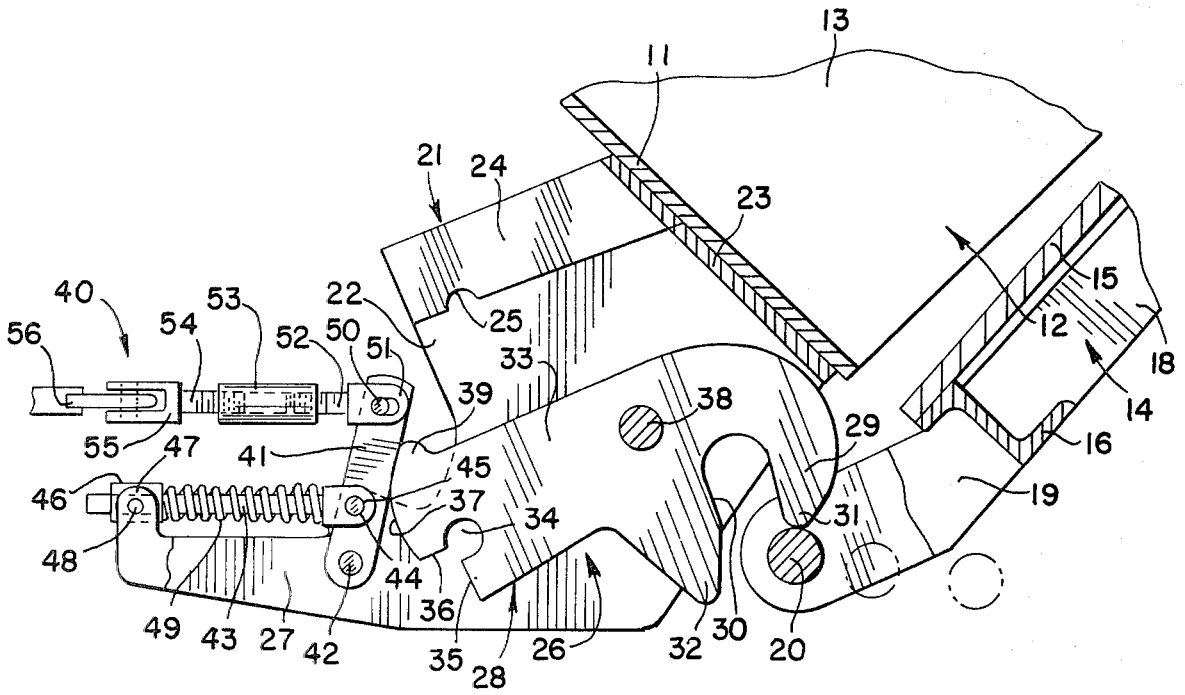
FIG. 2 shows an enlarged view similar to FIG. 1 showing the latch arrangement in a release position.

FIG. 1 discloses the locked position of the rotor or keeper member 28. Upon a pull on the chain 56, by suitable actuating means not shown, the lever 41 is pivoted, releasing its upper end position which is in locking relation against the abutments 35 and 36, whereby the door 14 is moved downwardly in a hinged manner, the same being hingedly mounted on the hopper structure (not shown). The lever 41 is now in camming relation relative to the cam face 37 and retains the rotor in the position indicated in FIG. 2 by the biasing force of the spring 43. Thus the latch rotor is positioned to again gather the pin 20 upon the movement of the door to its closed position whereupon the closed position again is assumed as indicated in FIG. 1.

Thus the latch combination disclosed provides for increased performance in that the release forces required have been materially reduced. Also, the rotor will remain in the open position until the doors are closed which may be accomplished by track tripping devices conventional in the art. Further, the over-center force at the spring arrangement holds the rotor in the open or locked position. This will insure proper locking and prevent damage to the rotor.

What is claimed:

1. A closure locking mechanism for a railway hopper car including a discharge opening, closure means mounted for movement adjacent said opening and selectively closing the same and having a keeper rod disposed thereon, latching means positioned adjacent said closure means and adapted to engage and lock the same in its closed position, said latching means including bracket means attached to a hopper, a self-supporting latch member pivotally mounted by a pivot pin on said bracket means and having a keeper gathering opening adapted to move to one position to be aligned with said keeper rod to receive and hold the keeper rod and further to move to another position to latch the keeper rod, said latch member including a cam portion, and having a recessed abutment means, lever means pivotally mounted on said bracket means, and means biasing said lever means into engagement with said abutment means and said cam portion respectively whereby the latch member is positioned to initially engage the keeper rod and maintain it in said closed position.

2. The closure locking mechanism of claim 1 wherein the latch member includes a keeper gathering opening at one end thereof and said cam surface being disposed at the other end of said rotor.

3. The closure locking mechanism of claim 1 wherein said cam portion and adjacent abutment means are disposed in adjacent relation.

4. The closure locking mechanism of claim 1 wherein said latch member is planar and is pivoted to permit the latch member to move freely to the position to receive the keeper rod.

5. The closure locking mechanism of claim 1 wherein the rod is formed on a door extension.

6. The closure locking mechanism of claim 1 wherein the lever means is pivotally mounted at one end to said bracket means with the biasing means being disposed on said bracket means to engage said lever means and urge the same into engagement with said latch member.

7. The closure locking mechanism of claim 1, said lever means having a portion thereof movable into engagement with said abutment means for locking said rotor in a closed position.

8. The closure locking mechanism of claim 1, and said latch member having an F-shape configuration.

9. The closure locking mechanism of claim 1, wherein said bracket means comprising an L-shaped bracket.

10. The closure locking mechanism of claim 8, wherein said latch member is engageable with an upper portion of said bracket means.

* * * * *